US005852969A

United States Patent [19]

Anthony

[11] Patent Number: 5,852,969

[45] Date of Patent: Dec. 29, 1998

[54] DEVICE FOR REDUCING BALE PACKAGING FORCES

[75] Inventor: William S. Anthony, Greenville, Miss.

[73] Assignee: The United States of America as represented by the Secretary of Agriculture, Washington, D.C.

[21] Appl. No.: 890,890

[22] Filed: Jul. 10, 1997

[51] Int. Cl.[6] ..... B65B 13/06; B30B 15/06

[52] U.S. Cl. ..... 100/34; 100/1; 100/3; 100/295

[58] Field of Search ..... 100/1, 3, 11, 34, 100/295

[56] References Cited

U.S. PATENT DOCUMENTS

| | | | |
|---|---|---|---|
| 153,333 | 7/1874 | Grader | 100/1 |
| 185,070 | 12/1876 | Boardman | 100/1 |
| 203,880 | 5/1878 | Blossom | 100/34 |
| 591,333 | 10/1897 | Duval | 100/1 |
| 1,332,644 | 3/1920 | Turner | 100/1 |
| 1,332,646 | 3/1920 | Turner | 100/1 |
| 1,332,648 | 3/1920 | Turner | 100/1 |
| 1,332,649 | 3/1920 | Turner | 100/1 |
| 1,352,345 | 9/1920 | Becker | 100/3 |
| 3,613,567 | 10/1971 | Loughran | 100/3 |
| 4,092,912 | 6/1978 | Simich | 100/3 |
| 4,391,186 | 7/1983 | Davis | 100/3 |

FOREIGN PATENT DOCUMENTS

| | | | |
|---|---|---|---|
| 388912 | 10/1973 | U.S.S.R. | 100/295 |

*Primary Examiner*—Stephen F. Gerrity
*Attorney, Agent, or Firm*—M. Howard Silverstein; Joseph A. Lipovsky; John D. Fado

[57] ABSTRACT

A bale press for compressing a bale of compressible material such as cotton is described. The bale press includes a base frame structure and a pair of platens which have generally rectangular bale compressing faces for compressing a cotton bale to facilitate the bale tieing operation. The platens are carried by the base frame structure so that they may be moved relatively toward a compression zone to compress a cotton bale sufficiently to enable the bale tie wires to be applied. A plurality of elongated, wedge-shaped, bale compression members are provided on at least one of the platens. These bale compression members protrude outwardly from the platen where they are mounted to provide a compression area which is sufficiently small so that the cotton bale is compressed only in close proximity to the positions where a single bale tie is to be placed. A sufficient number of bale compression members are provided to facilitate the application of the ties required for the bale. Through the use of such bale compression members, the overall horsepower required to operate the bale press may be significantly reduced.

13 Claims, 4 Drawing Sheets

DEVICE FOR REDUCING BALE PACKAGING FORCES

BACKGROUND OF THE INVENTION

1. Field of the Invention

This invention relates to bale packaging and in particular to a device and methodology for reducing the forces necessary for material compression during the bale formation process.

2. The Prior Art Background

The annual production of cotton in the United States is approximately 18 to 20 million bales, with each bale weighing about 500 pounds. Gins typically produce a bale of cotton about every 2 to 3 minutes. This is most commonly accomplished by having the cotton fiber flow down an inclined plane into a preliminary tramping mechanism which forces the cotton into a rectangular box. Once the box contains the desired amount of cotton, it is positioned such that a considerable compressive force may be applied so that a tightly packed and tied bale may be produced. To speed up the process it is conventional to equip gins with two boxes so that one box may be filled as the cotton in the other is being compressed.

Bale presses generally apply between about 600,000 to 1,000,000 pounds of force to the cotton. This is accomplished by compressing it between a pair of 20×54 inch rectangular plates commonly referred to as platens.

The platens conventionally have from six to eight grooves therein that are about one-inch wide and about two inches deep. These grooves facilitate the insertion of bale ties, comprising round wires or flat straps of steel or polyester, once the bale is in a compressed state and possesses a density ranging from about 40 to 42 pounds per cubic foot.

Tie-off of the bales is accomplished by inserting bale ties possessing a typical length of about 89 inches through the grooves in the platens so as to encircle the bale. The loose ends of the ties are then connected together in a conventional manner. The compressive force is then released and the bale is allowed to expand to occupy whatever dimensions the restraining bale ties permit. The final dimensions of the bales are typically about 21 inches by about 54 inches by about 26 to 30 inches.

Conventional bale tie accommodating grooves are about one inch in width. This is sufficiently narrow to prevent their occlusion due to the tendency of the compressing cotton to bridge the void represented by the groove, rather than to fill it. The platen area subjected to the full compressive force thus exceeds 2160 square inches in the conventional baling operation. The amount of force which is needed for compression of such a surface area is considerable. Accordingly, any new method or device which reduces the amount of force necessary to perform the baling function would be enthusiastically welcomed by the industry.

SUMMARY OF THE INVENTION

The present invention provides a device and methodology for reducing the amount of force necessary for compressing a bale of compressible material during the baling operation. The invention provides a bale press having opposed outer surfaces that compress a bale by forcing the outer surfaces of the bale toward one another, thus reducing bale dimensions and facilitating its securing with bale ties. While the primary purpose of such a device and such methodology is to bale cotton, the invention may also be used for baling other compressible materials such as lint cleaner waste, polyester, nylon, kenaf and jute.

The bale press of the invention comprises a base frame structure and a pair of opposed platens. Each of the platens is respectively provided with a generally rectangular bale compressing face having dimensions of length and width which are essentially coextensive in size with the outer faces of the bale which are to be subjected to compression. The platens are carried by the base frame structure with the faces thereof disposed in a spaced, substantially aligned and parallel relationship, presenting a bale compression zone therebetween. The platens are mounted on the base frame structure for relative movement of their compressing faces toward one another to thereby reduce the volume of the compression zone.

In accordance with the invention a plurality of elongated, generally wedge-shaped bale compression members are provided for preforming the bale. The wedge-shaped members each have a longitudinal dimension, a lateral dimension and a thickness, and are mounted on at least one of the platens with the longitudinal dimensions of the members extending across the width of the face of the platen on which the members are respectively mounted and with the lateral dimensions of the members extending outwardly away from the face of the platen on which the members are respectively mounted and toward the compression zone. Each of the wedge-shaped members thereby presents a longitudinally extending distal compression edge spaced from the face of the respective platen. The thickness of the distal edge of each member is sufficiently small to compress a cotton bale only in close proximity to a position where a single bale tie is to be placed. This distal edge, including the width of the recess over which the compressible fibers will bridge, has a composite thickness ranging from about 0.7 inches to 2 inches, preferably from about 0.75 inches to about 1 inch.

The bale press further includes a drive mechanism that is mechanically coupled to at least one of the platens and is operable to move the platens relatively toward one another.

In accordance with a preferred form of the invention, the bale compression members are mounted on both platens. Furthermore, the distal edge of each of the members is preferably provided with a longitudinally extending bale tie receiving recess therein. In a particularly preferred form of the invention, each of the members has a hollow truncated V-shaped cross-sectional configuration.

In the preferred bale press of the invention, the platens are each provided with a series of slots which extend across the width of the face thereof. The bale compression members each have a longitudinally extending base edge which is oriented as a lateral extension of the bale compression member relative to the distal compression edge. The bale compression members are mounted on the platens with the base edges received in respective slots of the platens.

In a particularly preferred form of the invention, the bale compression members are shaped such that the distal edges thereof are located at least about three inches from the face of the platen on which the members are mounted. Moreover, it is preferred that the thickness of each member at the distal edge thereof should range from about 0.7 inches to two inches, most preferably from about 0.75 inches to about 1 inch.

In accordance with a preferred aspect of the invention, eight bale compression members are mounted on each platen with the members being laterally spaced approximately 5 ½ inches on center across the face of the platen.

In accordance with the invention each of the distal edges, which represent a bale compression surface, with the sum of these surfaces possessing a bale compression area substantially less than the area of the face of the platen itself. In a particularly preferred form of the invention, the ratio of the total bale compression surface area of the members on a given platen to the area of the face of the platen itself may range from about 1:3 to about 1:12, preferably from about 1:5 to about 1:9.

The invention also provides a method for compression of material bales having opposed outer surfaces which are generally rectangular in shape. The method comprises pushing against opposing surfaces of the material bale from directions generally perpendicular thereto. The method further includes a focussing of the compressive force along the compression members mounted on the bale contacting surfaces of one or both compression platens. Each of the compression members have a longitudinal dimension extending across the width of the outer surface of the bale and a lateral dimension that is sufficiently small so as to push against the bale only in close proximity to where a bale tie is to be placed.

The invention also provides a bale compression member which is useful ir connection with the bale press described above.

DETAILED DESCRIPTION OF THE PREFERRED EMBODIMENTS

Figure 1:
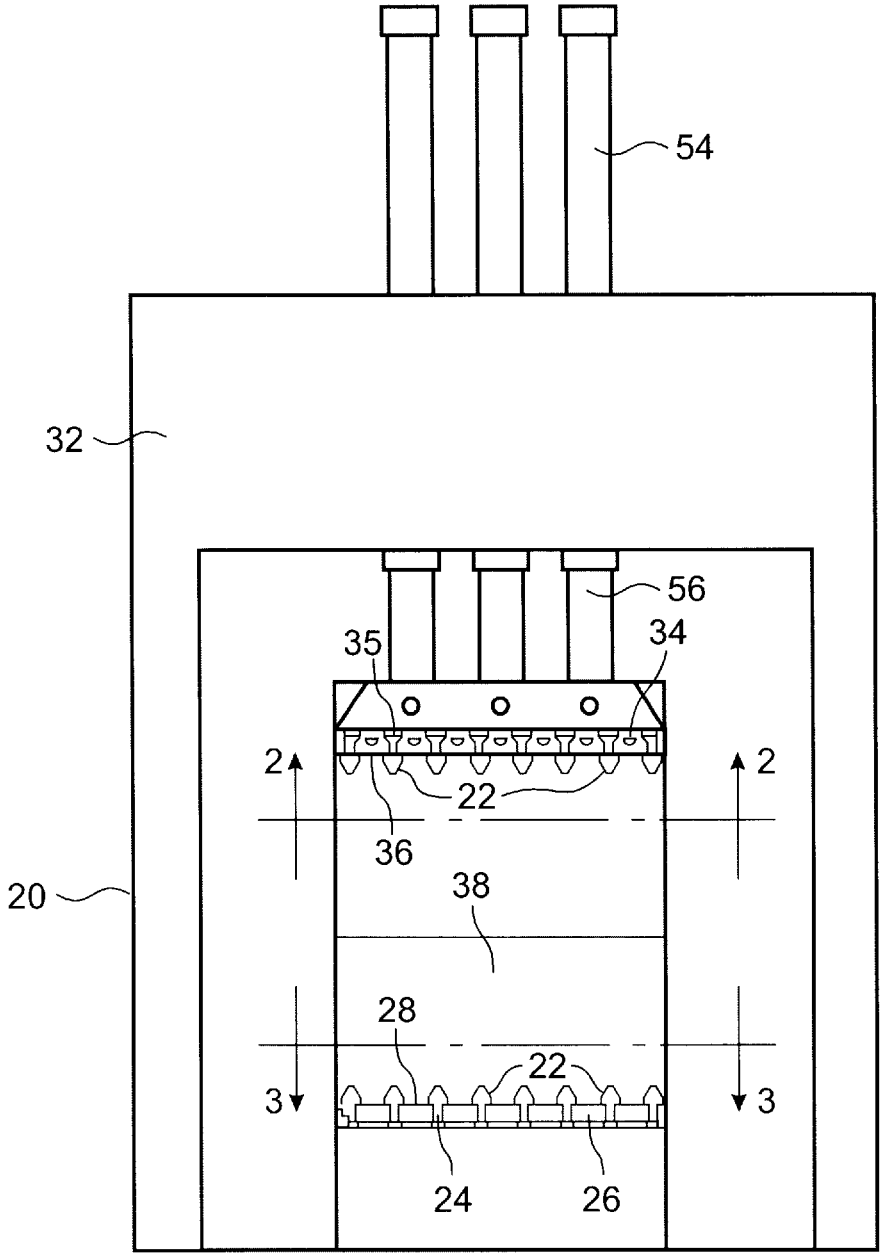
FIG. 1 is a schematic, front elevational view of a bale press which embodies the principles and concepts of the invention and wherein the platens are shown in a retracted condition.

With reference to FIG. 1, the invention provides a bale press 20 that is equipped with specially configured bale compression members 22. Respective members 22 are affixed inside slots 35 and 24 provided respectively in the upper platen 34 and lower platen 26 of the bale press 20. In accordance with the invention, the bale compression members 22 preferably protrude upwardly from the upper face 28 of lower platen 26 and downwardly from lower face 36 of the upper platen 34 for a distance of about two to three inches and have a hollow, truncated V-shaped configuration such as that seen in FIGS. 4 and 5. The members 22 are each provided with a tie receiving recess 30 which facilitates the application of the tie to the compressed bale.

With further reference to FIG. 1, the bale press 20 includes a base frame structure 32, the lower platen 26 and the upper platen 34. Platens 26 and 34 are carried by the base frame structure 32 with their respective faces 28 and 36 disposed in substantial parallelism, in spaced apart relationship, and in substantial alignment so as to present a bale compression zone 38 therebetween. The platens 26 and 34 are mounted on the base frame structure 32 for relative movement toward and away from one another. Thus, as the platens 26 and 34 move relatively toward one another, the vertical dimension of zone 38 is reduced.

Figure 2:
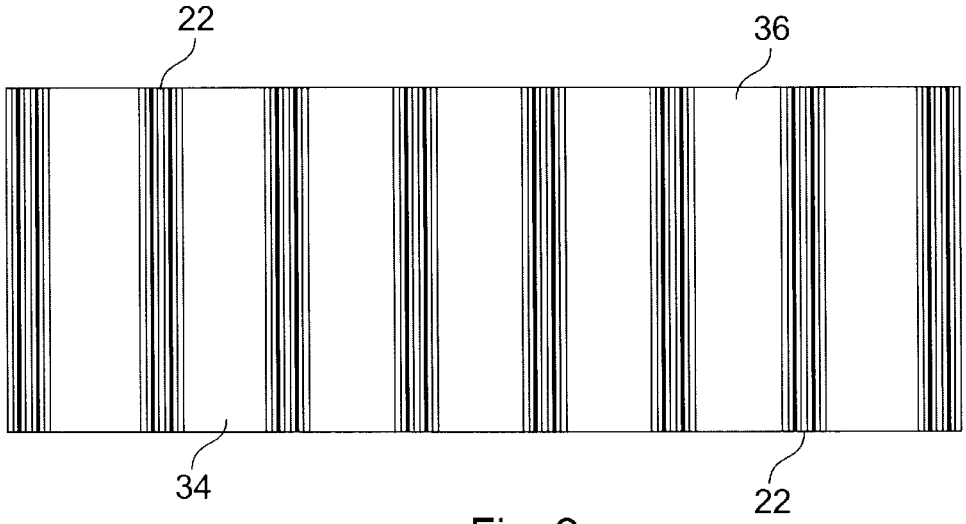
FIG. 2 is a plan view of the upper platen of the bale press of FIG. 1 taken essentially along the line 2—2 of FIG. 1.

With reference to FIG. 2 it can be seen that the lower face 36 of upper platen 34 presents a generally rectangular bale compressing face. The face 36 has a length and a width and an area which is essentially coextensive in dimensional size with the outer surface area 40 of a cotton bale 42 which is being compressed in the bale press 20. Moreover, with reference to FIG. 3 it can be seen that the upper face 28 of lower platen 26 also presents a generally rectangular bale compressing face which has a length and a width and an area which is essentially coextensive in dimensional size with the area of the lower outer surface 44 of the bale 42. The cotton bale 42 and its upper and lower outer surfaces 40 and 44 are illustrated schematically in FIG. 4.

Figure 5:
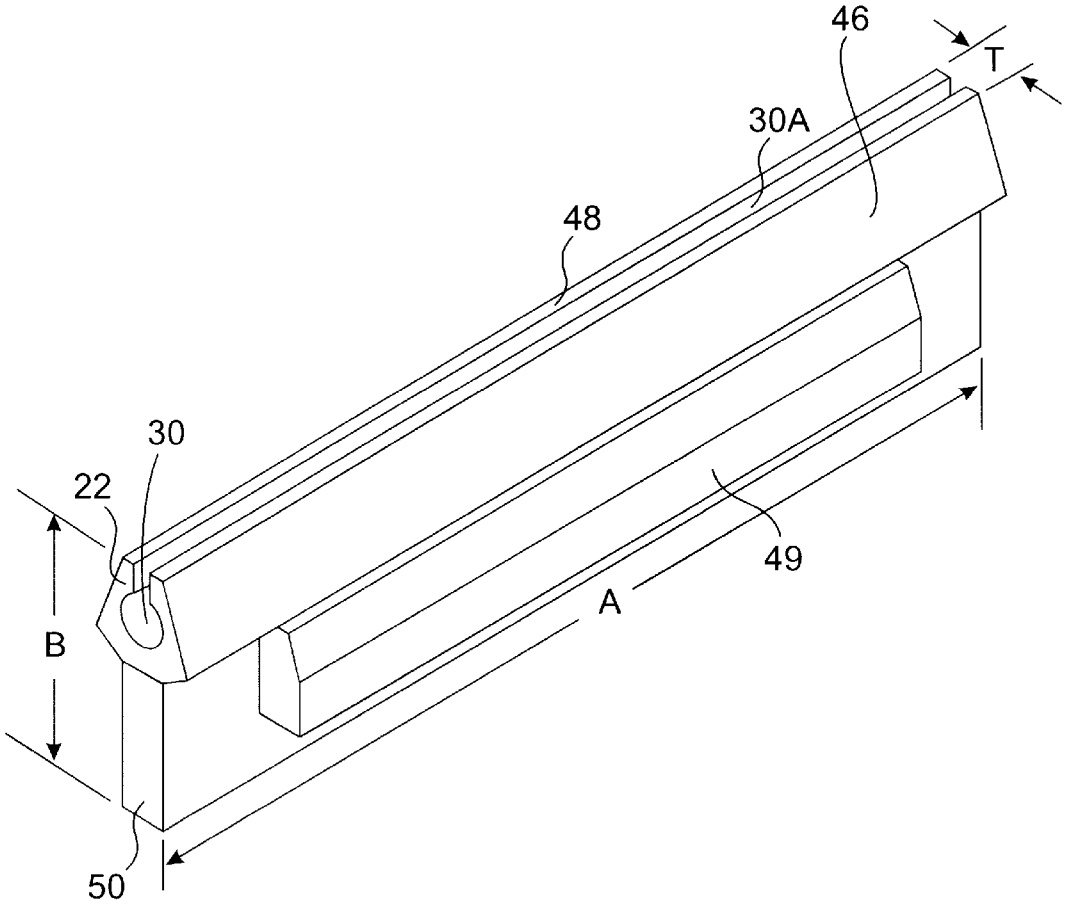
FIG. 5 is an isometric view illustrating a bale compression member of the invention which is incorporated in the bale press of FIG. 1.

A preferred embodiment of the bale compression members 22 is illustrated with particularity in FIG. 5. Thus, it can be seen that each member 22 has a longitudinal dimension A and a lateral dimension B. In accordance with the invention each member 22 is provided with a longitudinally extending distal compression edge 46 providing a bale compression surface 48. The member 22 also has a base edge 50 which is spaced laterally of the bale compression member 22 relative to the distal compression edge 46.

The thickness T of the bale compression member 22 at the distal compression edge 46 thereof, is sufficiently small to compress a cotton bale only in close proximity to a position where a tie is to be placed as will be explained in greater detail hereinafter. Compression members 22 have a generally wedge-shaped cross-sectional configuration.

Figure 3:
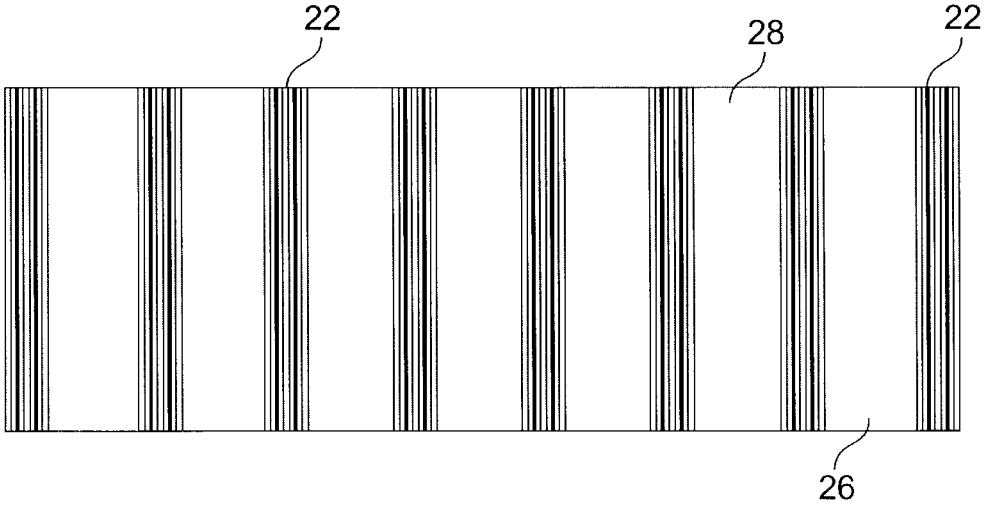
FIG. 3 is a plan view of the lower platen of the bale press of FIG. 1 taken essentially along the line 3—3 of FIG. 1.
Figure 4:
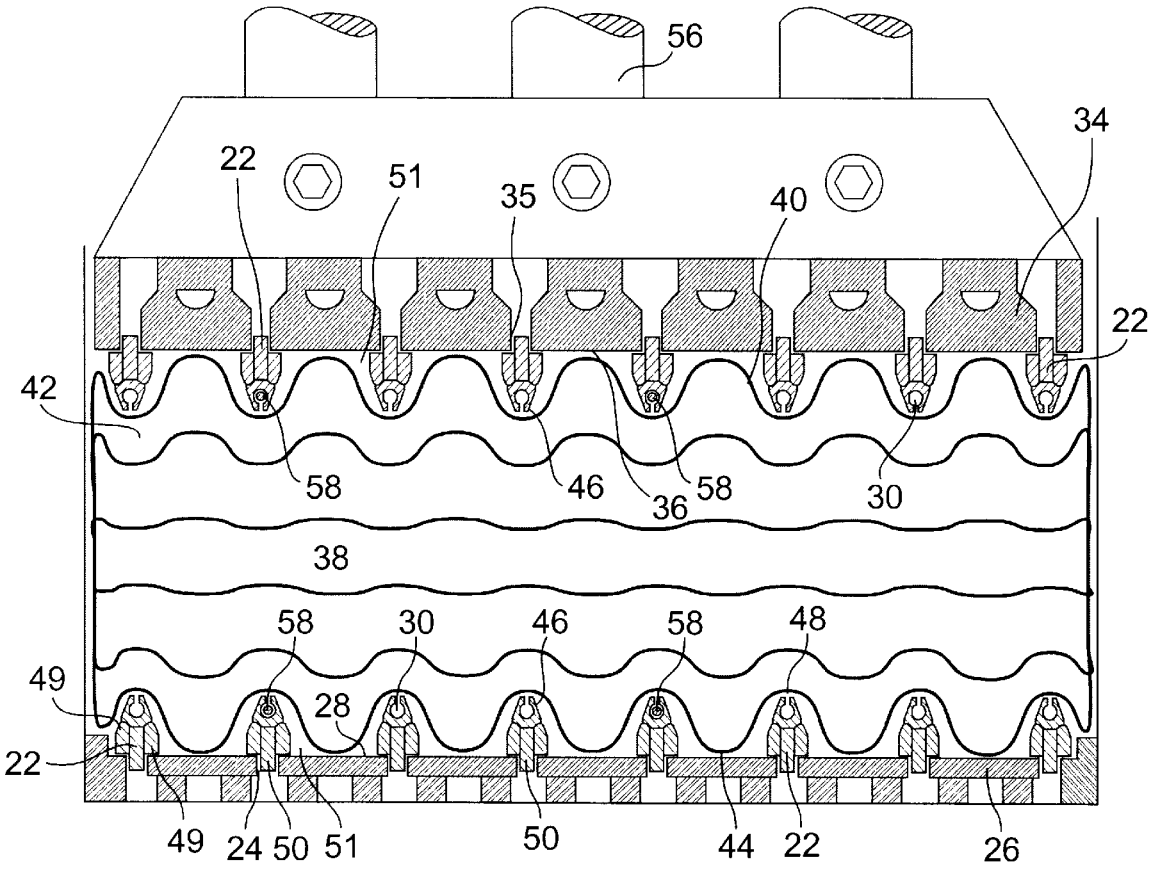
FIG. 4 is an enlarged, partial front elevational view of the bale press of FIG. 1, wherein the platens are illustrated in an actuated position with a cotton bale compressed therebetween.

As can be seen viewing FIGS. 2, 3 and 4, the bale compression members 22 are mounted on the upper and lower platens 26, 34 with their base edges 50 received in the slots 24, 35; these being provided in the upper platen 34 and lower platen 26 respectively. The members 22 carried by platen 34 may preferably be attached thereto by conventional fasteners such as nut and bolt arrangements, or by welding. Each compression member 22 may also be provided with a pair of stabilizer bars 49 which hold the member in a proper position relative to the platens 26, 34 when the members are mounted in the slots 24, 35. Thus, the bale compression members 22 are each mounted such that the longitudinal dimension A thereof extends across the width of the corresponding platens 26 and 34. With particular reference to FIG. 4 it can also be seen that the members are carried by the platens 26, 34 such that lateral dimension B of each member 22 extends outwardly away from face 28 of platen 26 or face 36 of the platen 34, as the case may be, and toward the compression zone 38 which as shown in FIG. 4, is filled with the bale 42. Hence, the longitudinally extending distal compression edges 46 of the bale compression members 22 are spaced from the respective faces 28 and 36 of platens 26 and 34 on which they are mounted. It can also be seen viewing FIG. 4 that valleys 51 are thus provided between the members 22. As shown in FIG. 4, each member 22 on platen 34 should preferably be positioned in direct vertical alignment with a corresponding member 22 on platen 26.

The press 20 may be provided with a plurality of pneumatic piston and cylinder assemblies 54 for moving the platen 34 toward platen 26 to compress a cotton bale 42 which is disposed in zone 38. The assemblies 54 thus move platens 26 and 34 relatively toward one another. Such piston and cylinder assemblies 54 are illustrated schematically in FIG. 1, where it can be seen that the piston and cylinder assemblies 54 provide a drive mechanism which is mechanically coupled by way of the piston rods 56 to upper platen 34 for moving the platens 26 and 34 relatively toward and away from the bale 42 in the zone 38.

In operation, the piston and cylinder assemblies 54 of the bale press 20 are actuated to move the platens 26 and 34 relatively toward one another to force the surfaces 40 and 44 of the cotton bale 42 toward one another to reduce the vertical dimension of the bale 42 and thereby facilitate the securing of the bale 42 with bale ties. Compression members 22 preform the bale 42 so that the portions thereof where a tie is to be positioned are compressed to a greater extent than the portions of the bale which are between the members 22 and which flow into the valleys 51. To facilitate the application of the bale ties to the bale, recesses 30 are provided in the bale compression members 22. Two bale ties 58 are illustrated schematically in cross-section in FIG. 4; however, it would be readily appreciated by those of ordinary skill in the art to which the present invention applies that it is conventional to use six to eight bale ties to secure a bale such as the bale 42. Thus, a bale tie such as the bale tie 58 would be provided at each location defined by corresponding recesses 30.

It can readily be seen viewing FIG. 4, that the surfaces 40 and 44 of the bale 42 are essentially opposed horizontal surfaces and that the platens 26 and 34 push against the surfaces 40 and 44 in an essentially perpendicular direction.

As can be seen viewing FIG. 4, there are preferably eight bale compression members 22 mounted on each of platens 26 and 34. The platens typically each have a length of about 54 inches and the members 22 are preferably spaced laterally apart along the length of platens 26 and 34 on centers which are about 5 ½ inches apart. The distal edges 46, which are preferably positioned about two to three inches from the face 28 of the platen 26 and the face 36 of the platen 34, may have a thickness of approximately one inch. The longitudinal dimension of each member 22 is preferably about 20 inches whereby each bale compression surface 48 has an area of approximately 20 square inches. In this regard it should be noted that the mouths 30A of the grooves 30 are sufficiently small that the cotton fibers simply bridge the gap so that the surface 48 may be considered to be a continuous surface.

As mentioned previously, the platens 26, 34 have respective areas of 1,080 square inches and the eight members 22 mounted thereon have a total bale compression surface ranging from about 90 to about 320 square inches. Thus when the present invention is employed, the total bale compression surface area is substantially less than the respective areas of the faces of the platens. In fact, the ratio of the total compression area provided by the surfaces 48 to the area of the faces of the platens 26, 34 will range from about 1:12 to about 1:3.

The present invention recognizes that compressive forces applied in the baling process need only be directed at the points where the bale ties are attached rather than to the entire bale. By not requiring the bale to be reversibly compressed in the valleys 51 between the members 22, the total compressive force that is required in the process is significantly reduced. Thus, total compression force requirements typically drop from about 700,000 lbs. to about 450,000 lbs., and horsepower requirements drop from about 300 to about 200. This has the multiple benefit of lowering energy consumption and reducing equipment size and cost. In this connection it is theorized that through the use of the invention the compressive forces required to process each bale may be reduced by approximately 35%, depending upon the actual density, fiber moisture, fiber distribution, fiber length, micronaire, and other factors which are well known to the routineer in the relevant art.

In accordance with the invention, the bale compression members preform the bale as illustrated in FIG. 4 and allow the compressive forces to be applied primarily in the areas adjacent the surface 48 where the ties are to be placed. The cotton assumes the shape of the platens and the members 22 thereon, so that the density at maximum compression is approximately 40 to 42 lbs. per cubic foot in the tie area but decreases to about 30 to 32 lbs. per cubic foot in the valleys 51 between the members 22.

In the preferred embodiment described above, the members 22 are configured to be used in conjunction with conventional upper and lower platens such as the platens 26, 34. However, as would be readily appreciated by those of ordinary skill in the art, the platens and the compression members could very well be assembled as a single unit. Moreover, although the bale compression members are shown as being mounted on the both platen 26 and platen 34, the same could, in accordance with the invention, be mounted instead on only the lower platen 26 or only on the upper platen 34. In this case the forces needed to compress a bale of cotton are reduced by only about 20%, which still represents a significant savings.

Furthermore, in the preferred embodiment described above, the press is shown as a "downpacking" press. Again as would be appreciated by those of ordinary skill in the art, the invention also could be employed in connection with an "uppacking" press or in a press where both the upper and lower platens move toward the bale compression zone. In this regard it is simply to be recognized that the only important thing is that at least one of the platens is moved so that the platens move relatively to thereby reduce the dimension of the cotton bale positioned therebetween. The invention may also be employed with presses which operate at other than vertically orientations, such as for example horizontal. Although the bale has been depicted as being rectangular in shape, those skilled in the art will appreciate that the concepts and principles of the invention may also be equally applied to bales of other geometric configuration.

I claim:

1. A bale press for compressing a bale of compressible material having opposed outer surfaces by forcing said outer surfaces toward one another to reduce the dimensions of the bale and thereby facilitate securing of the bale with bale ties, said bale press comprising:

a base frame structure;

first and second platens, each provided with a respective generally rectangular bale compressing face having a length and a width and an area which is essentially coextensive in dimensional size with an area of a respective one of said surfaces, said platens being carried by said base frame structure with said faces thereof disposed in substantial parallelism, in spaced apart facing relationship, and in substantial alignment to present a bale compression zone therebetween, said platens being mounted on said base frame structure for relative movement of said faces toward one another to reduce a dimension of said zone;

a plurality of elongated, wedge-shaped, bale compression members, said wedge-shaped members each having a longitudinal dimension, a lateral dimension and a thickness, said wedge-shaped members being mounted on at least one of said platens with the longitudinal dimensions thereof extending across the width of the face of the platen on which the members are respectively mounted and with the lateral dimensions thereof extending outwardly away from the face of the platen on which the members are respectively mounted and toward the compression zone, each said member thereby presenting a longitudinally extending distal compression edge spaced from the face of the respective platen, the thickness of each member at the distal edge thereof being sufficiently small to compress a cotton bale only in close proximity to a position where a single bale tie is to be placed;

wherein said at least one of said platens is provided with a series of slots which extend across the width of the face thereof, said bale compression members each having a longitudinally extending base edge which is oriented as a lateral extension of the bale compression member relative to said distal compression edge thereof, said bale compression members being mounted on said at least one of said platens with said base edges received in respective slots; and a drive mechanism that is mechanically coupled to at least one of said platens and operable to move the platens relatively toward one another.

2. A bale press as set forth in claim 1, wherein said bale compression members are mounted on both the first platen and the second platen.

3. A bale press as set forth in claim 2, wherein there are eight members mounted on each said platen and the members are spaced laterally approximately 5.5 inches apart across the face thereof.

4. A bale press as set forth in claim 3 wherein the thickness of each compression member at the distal edge thereof ranges from about 0.7 inches to about 2 inches.

5. A bale press as set forth in claim 1, wherein the distal edge of each said member is provided with a longitudinally extending bale tie receiving recess therein.

6. A bale press as set forth in claim 5 wherein each said member has a hollow, truncated, V-shaped cross-sectional configuration.

7. A bale press as set forth in claim 1, wherein said distal edges of the members are located at least about three inches from the face of the platen on which the members are mounted.

8. A bale press as set forth in claim 1, wherein the thickness of each compression member at the distal edge thereof ranges from about 0.7 inches to about 2 inches.

9. A bale press as set forth in claim 1, wherein each said distal edge presents a bale compression surface and the distal edges of the members mounted on each platen provide a total bale compression surface area which is substantially less than the area of the face of the platen.

10. A bale press as set forth in claim 9 wherein the ratio of the total bale compression surface area of the members on said at least one platen to the area of the face of the platen ranges from about 1:12 to about 1:3.

11. A bale compression member for use in a bale press for compressing a bale of compressible material having opposed outer surfaces by forcing said outer surfaces toward one another to reduce the dimensions of the bale and thereby facilitate securing of the bale with bale ties, said bale press comprising a base frame structure and first and second platens, each said platen being provided with a respective generally rectangular bale compressing face having a length and a width and an area which is essentially coextensive in dimensional size with an area of a respective one of said surfaces, said platens being carried by said base frame structure with said faces thereof disposed in substantial parallelism, in spaced apart facing relationship, and in substantial alignment to present a bale compression zone therebetween, said platens being mounted on said base frame structure for relative movement of said faces toward one another to reduce a dimension of said zone, said press further including a drive mechanism that is mechanically coupled to at least one of said platens and operable to move the platens relatively toward one-another, said bale compression member being characterized by having a longitudinal dimension, a lateral dimension and a thickness, and being configured and adapted for inserting into a slot in at least one of said platens with the longitudinal dimension thereof extending across the width of the face of the platen on which the member is to be mounted, and with the lateral dimension thereof extending outwardly away from the face of the platen on which the member is to be mounted and toward the compression zone, said member thereby presenting a longitudinally extending distal compression edge spaced from the face of the respective platen, the thickness of the member at the distal edge thereof being sufficiently small to compress a bale only in close proximity to a position where a single bale tie is to be placed.

12. A bale compression member as set forth in claim 11, wherein the distal edge of said member is provided with a longitudinally extending bale tie receiving recess therein.

13. A bale compression member as set forth in claim 12, wherein said member has a hollow, truncated, V-shaped cross-sectional configuration.

* * * * *